United States Patent [19]

Satoh et al.

[11] Patent Number: 4,873,724

[45] Date of Patent: Oct. 10, 1989

[54] MULTI-PULSE ENCODER INCLUDING AN INVERSE FILTER

[75] Inventors: Yayoi Satoh; Toshihiko Mizukami, both of Tokyo, Japan

[73] Assignee: NEC Corporation, Tokyo, Japan

[21] Appl. No.: 74,193

[22] Filed: Jul. 16, 1987

[30] Foreign Application Priority Data

Jul. 17, 1986 [JP] Japan ..... 61-168901

[51] Int. Cl.[4] ..... G10L 5/00

[52] U.S. Cl. ..... 381/40; 381/41; 381/51; 381/49

[58] Field of Search ..... 381/40, 41, 49, 51–53

[56] References Cited

U.S. PATENT DOCUMENTS 4,809,330 2/1989 Tanaka et al. ..... 381/40

*Primary Examiner*—Emanuel S. Kemeny

*Attorney, Agent, or Firm*—Foley & Lardner, Schwartz, Jeffery, Schwaab, Mack, Blumenthal & Evans

[57] ABSTRACT

In an encoder for use in encoding a speech signal into a plurality of excitation pulses within frames by the use of an autocorrelation and a cross-correlation derived in relation to the speech signal, the cross-correlation is produced through an inverse filter and a convolution filter having an impulse response determined in connection with the autocorrelation. The autocorrelation is normalized with respect to a maximum value thereof while the cross-correlation is also normalized in response to the normalized autocorrelation. A search for the excitation pulses is made with reference to the autocorrelation and the cross-correlation both of which are normalized.

6 Claims, 3 Drawing Sheets

MULTI-PULSE ENCODER INCLUDING AN INVERSE FILTER

BACKGROUND OF THE INVENTION

This invention relates to an encoder for use in encoding a speech signal into a plurality of excitation pulses which specify a sound source or a voice tract.

A conventional encoder of the type described is disclosed in U.S. Pat. No. 4,809,330 issued Feb. 28, 1989 to Tanaka et al and assigned to the instant assignee. In the Tanoka encoder, a speech signal is divided into a sequence of frames and each frame is encoded into a plurality of excitation pulses by the use of an autocorrelator and a cross-correlator. More particularly, a cross-correlation signal is derived not only from a current frame but also from a part of the next frame so as to remove interaction between the current and the next following frames. The excitation pulses for each frame are produced as a result of a pulse search operation carried out by the use of the above-mentioned cross-correlation signal for a pulse search duration longer than each frame.

With this structure, complicated compensation is required for every frame in connection with a previous frame. In addition, the pulse search operation is carried out for each frame over a pulse search duration longer than each frame. This makes the pulse search operation and a count of the excitation pulses difficult. Moreover, it is necessary to prepare a memory of a large memory capacity so as to store the speech signal because the pulse search operation is carried out over the pulse search duration which is typically two adjacent frames long.

Furthermore, it is to be noted that each value of the autocorrelation and the cross-correlation is usually fairly greater than unity when a fixed point calculation is carried out for calculating the autocorrelation and the cross-correlation. This results in expansion of a dynamic range for calculation of the autocorrelation and the cross-correlation and in degradation of both precision of calculation and quality of a reproduced voice.

SUMMARY OF THE INVENTION

It is an object of this invention to provide an encoder which can readily control pulse search operation.

It is another object of this invention to provide an encoder of the type described, which can make it possible to reduce memory capacity.

It is a further object of this invention to provide an encoder of the type described, wherein calculation precision can be improved even when a fixed-point calculation is carried out for calculating autocorrelation and cross-correlation.

An encoder to which this invention is applicable is for use in encoding a speech signal given through a vocal tract into a plurality of excitation pulses. Each has an amplitude and a location determined by the speech signal. The encoder comprises: parameter calculating means responsive to the speech signal for calculating a parameter specific to the speech signal to produce a parameter signal representative of the parameter, autocorrelation calculating means responsive to the parameter signal for calculating an autocorrelation related to the speech signal to produce an autocorrelation signal representative of the autocorrelation, cross-correlation calculating means coupled to the autocorrelation calculating means and responsive to the speech signal for calculation of a cross-correlation related to both the parameter and the speech signal to produce a cross-correlation signal representative of the cross-correlation, and excitation pulse producing means coupled to the autocorrelation calculating means and the cross-correlation calculating means for producing excitation pulses in response to the autocorrelation signal and the corss-correlation signal. According to this invention, the cross-correlation calculating means comprises an inverse filter, responding to the speech signal and having an inverse filter characteristic relative to the vocal tract, producing a residual signal representative of a residue resulting from passage of the speech signal through the inverse filter and filtering means coupled to the inverse filter and the autocorrelation calculating means for filtering the residual signal to produce a filtered signal. The filtering means has an impulse response determined by the autocorrelation signal. The cross-correlation calculating means further comprises signal supplying means for supplying the filtered signal to the excitation pulse producing means as the cross-correlation signal.

DESCRIPTION OF THE PREFERRED EMBODIMENT

Figure 1:
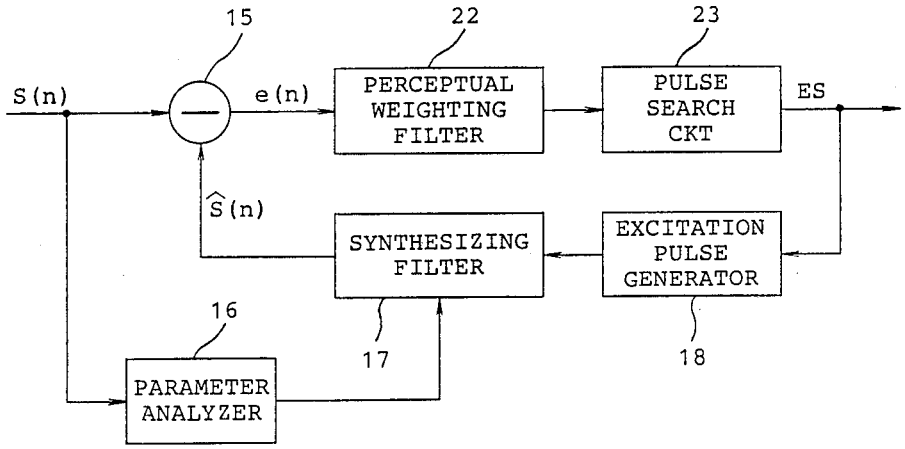
FIG. 1 PRIOR ART
FIG. 1 is a block diagram of a conventional encoder for use in describing principles of a multi-pulse excited coding method.

Referring to FIG. 1, description will be made regarding a conventional encoder in order to facilitate an understanding of the present invention. The conventional encoder is supplied with an input speech signal S(n) to produce an encoded signal ES which is representative of an amplitude and a location of excitation pulses determined in relation to the input speech signal S(n), where n is representative of an integer specifying a time instant. In the illustrated encoder, the input speech signal S(n) is delivered to a subtracter 15 and a parameter analyzer 16. The parameter analyzer 16 produces a parameter, such as a k-parameter, which is specific to the input speech signal S(n) and which is sent to a synthesizing filter 17. The synthesizing filter 17 is successively supplied from an excitation pulse generator 18 with reproductions of the excitation pulses derived from the encoded signal ES.

The synthesizing filter 17 supplies the subtracter 15 with a synthesized speech signal $\hat{S}(n)$ which is synthesized from the reproductions of excitation pulses and which is given by:

$$\hat{S}(n) = \sum_{i=1}^{k} g_i \cdot h(n - r_i), \tag{1}$$

where k represents the number of the excitation pulses; $g_i$, an amplitude of each excitation pulse; $r_i$, a location of each excitation pulse; and $h(n-r_i)$, and impulse response of the synthesizing filter 17.

Responsive to the input speech signal S(n) and the synthesized speech signal $\hat{S}(n)$, the subtracter 15 sends to a perceptual weighting filter 22 an error signal e(n) which is represented with reference to Equation (1) by:

$$\begin{aligned} e(n) &= S(n) - \hat{S}(n) \\ &= S(n) \sum_{i=1}^{k} g_i \cdot h(n - r_i). \end{aligned}$$

The error signal e(n) is sent through the perceptual weighting filter 22 to a pulse search circuit 23 as a weighted error signal. The pulse search circuit 23 is operable in accordance with a predetermined algorithm to minimize a mean-squared weighted error $E_k$ which may be given by:

$$E_k = \sum_{n=0}^{N-1} (e(n) * w(n)),$$

where N is representative of the number of samples; *, a convolution; and w(n), an impulse response of the perceptual weighting filter 22.

Herein, it is known in the art that the mean-squared weighted error $E_k$ can be minimized by the use of a relationship which is given between the location $r_k$ and the amplitude $g_k$ by:

$$g_k = \max_{0 \leqq r_k \leqq N-1} \left| R_{sh}(r_k) - \sum_{i=1}^{k-1} g_i \cdot R_{hh}(|r_k - r_i|) \right| \div |(R_{hh}(O))|, \quad (2)$$

where $$R_{sh}(r_i) = \sum_{n=0}^{N-1} S_w(n) \cdot h_w(n - r_i), \ (0 \leqq r_i \leqq N-1);$$

and $$R_{hh}(|r_i - r_j|) = \sum_{n=0}^{N-1} h_w(n - r_i) \cdot h_w(n - r_j), \ (0 \leqq r_i, r_j \leqq N-1);$$

and where in turn $S_w(n) = S(n) * w(n)$ and $h_w(n) = h(n) * w(n)$. Thus, the amplitude $g_k$ and the location $r_k$ can be calculated by the use of cross-correlation $R_{sh}$ between a weighted input speech signal $S_w$ and a weighted impulse response $h_w$ and by autocorrelation $R_{hh}$ of the weighted impulse response $h_w$.

Figure 2:
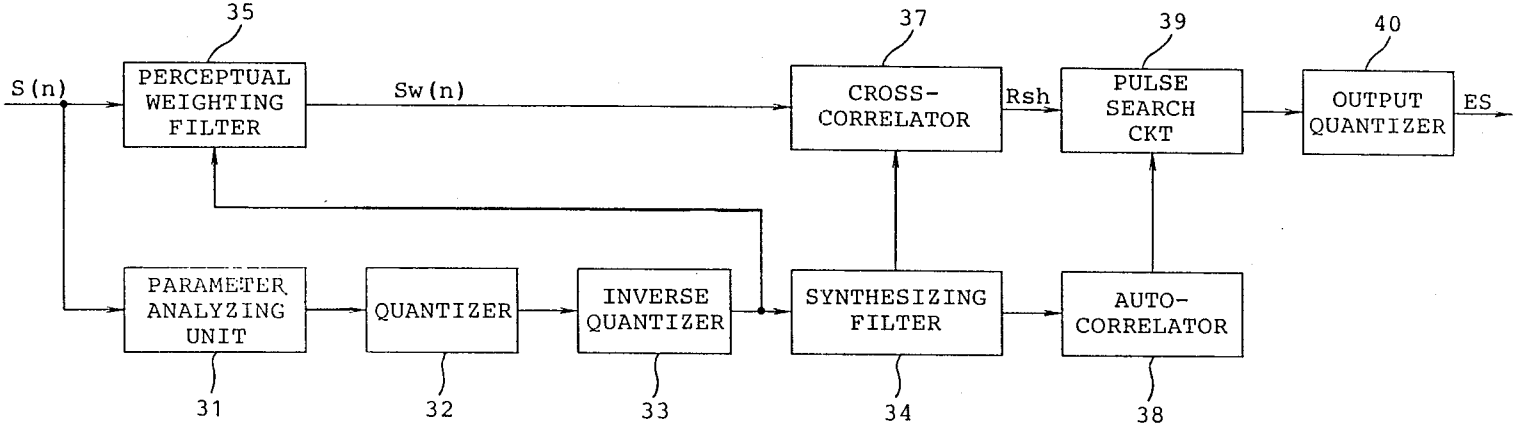
FIG. 2 PRIOR ART
FIG. 2 is a block diagram of another conventional encoder of the type described.

Referring to FIG. 2, another conventional encoder is operable in a manner similar to that illustrated in FIG. 1 and calculates the location $r_k$ and the amplitude $g_k$ of each excitation pulse in compliance with Equation (2). In the illustrated conventional encoder, the input speech signal S(n) is given by a sequence of samples represented by digital signals and is divisible into a succession of frames each of which consists of N samples.

The input speech signal S(n) is delivered to a parameter analyzing unit 31 and derives a single frame of N samples from the input speech signal S(n) to carry out a linear predictive coding (LPC) analysis and to calculate a predetermined parameter, such as a partial autocorrelation (PARCOR) coefficient, namely, a k parameter. At any rate, the predetermined parameter specifies a spectrum of the input speech signal. The predetermined parameter is quantized into a quantized parameter by a quantizer 32 and is thereafter inversely quantized into a reproduced quantized parameter by an inverse quantizer 33.

The parameter analyzing unit 31, the quantizer 32, and the inverse quantizer 33 may collectively be referred to as a parameter analyzer which is substantially equivalent to that illustrated in FIG. 1.

The reproduced quantized parameter is delivered to a synthesizing filter 34 and to a perceptual weighting filter 35 of an infinite impulse response (IIR) type. The perceptual weighting filter 35 is supplied with the input speech signal S(n) to produce a filtered output signal which is given by $S_w(n)$ weighted in accordance with the reproduced quantized parameter. The filtered output signal $S_w(n)$ may therefore be called a weighted speech signal and is sent to a cross-correlator 37.

On the other hand, the synthesizing filter 34 has a plurality of taps controlled by the reproduced quantized parameter and produces an impulse response signal representative of a weighted impulse response $h_w$ weighted by the reproduced quantized parameter. The impulse response signal is delivered to the cross-correlator 37 and to an autocorrelator 38. The cross-correlator 37 calculates the cross-correlation $R_{sh}$ between the weighted speech signal $S_w(n)$ and the weighted impulse response $h_w$ while the autocorrelator 38 calculates the autocorrelation $R_{hh}$ of the weighted impulse response $h_w$.

Responsive to the cross-correlation $R_{sh}$ and the autocorrelation $R_{hh}$, a pulse search circuit 39 successively searches an excitation pulse and determines an amplitude $g_k$ and a location $r_k$ in compliance with Equation (2). The amplitude $g_k$ and the location $r_k$ are quantized by an output quantizer 40 into an encoder signal ES.

In the above-referenced United States Patent Application, the perceptual weighting filter 35 is supplied with the N samples of a current frame and with M samples of the next following frame, where M is an integer smaller than N.

Figure 3:
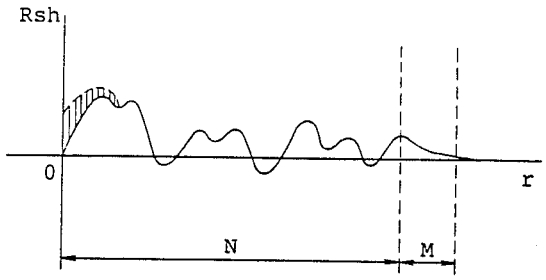
FIG.3 PRIOR ART
FIG. 3 shows a waveform for use in describing cross-correlation produced within the conventional encoder illustrated in FIG. 2.

Referring to FIG. 3, the cross-correlation $R_{sh}$ between the weighted speech signal $S_w$ and the weighted impulse $h_w$ is calculated for a pulse search duration defined by a sum of N and M. This shows that the pulse search duration lasts not only for the current frame but also for a part of the next following frame. In this event, compensation must be carried out so as to remove interaction from a previous frame . For this purpose, the cross-correlation $R_{sh}$ is modified into an adjusted cross-correlation $R_{sh}$ by carrying out partial compensation of the cross-correlation for a duration of L samples, as shown by a hatched portion in FIG. 3. Thus, it is possible to amend an influence of a previous frame to the current frame.

Practically, the pulse search duration lasts for a duration between a zeroth one of the samples and an (N−1+M)-th sample. On the other hand, practical pulse search should be continued for a time internal between the zeroth sample and the (N−1)-th sample until a predetermined number of the excitation pulses is detected within the time interval between the zeroth and the (N−1)-th samples.

Therefore, the conventional encoder has disadvantages as mentioned in the background of the instant specification.

Figure 4:
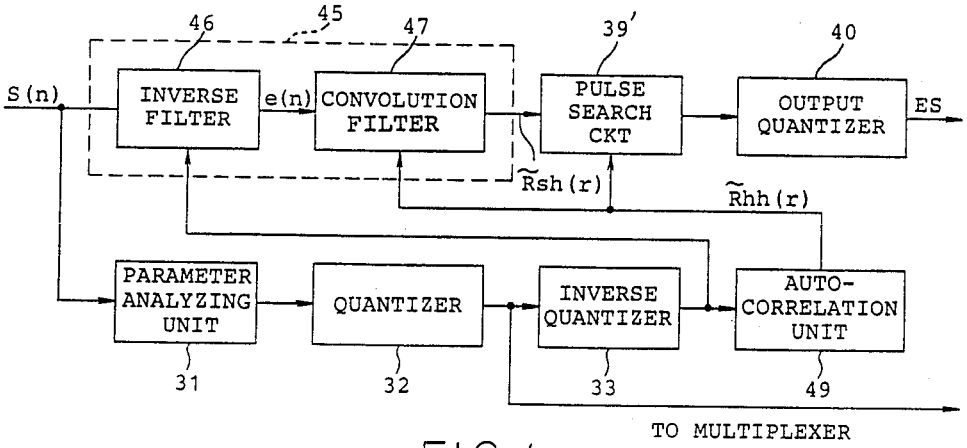
FIG. 4 is a block diagram of an encoder according to a preferred embodiment of this invention.

Referring to FIG. 4, an encoder according to a preferred embodiment of this invention comprises corresponding parts, designated by like reference numerals and symbols. As shown in FIG. 4, a cross-correlation circuit 45 comprises an inverse filter 46 of a finite impulse response type and a convolution filter 47 of a finite impulse response type. In addition, the inverse filter 46 may be formed by a non-recursive type filter while convolution filter 47 may be formed by a recursive type filter.

The encoder is supplied with the input speech signal S(n) through a vocal tract. Responsive to the input speech signal S(n), the parameter analyzing unit 31 extracts a single frame from the input speech signal S(n) by the use of a Humming window. The parameter analyzer 31 may be, for example, a linear predictive coding (LPC) analyzer for LPC analysis. As a result of the LPC analysis, a partial autocorrelation coefficient is calculated by the parameter analyzing unit 31 and is quantized into a quantized parameter in quantizer 32. The quantizer parameter is sent to a multiplexer (not shown) to be transmitted to a decoder and is also sent to the inverse quantizer 33. The quantizer parameter is subjected to inverse quantization by the inverse quantizer 33 and is produced as a reproduced parameter.

In the example being illustrated, the reproduced parameter is directly sent to an autocorrelation unit 49.

The autocorrelation unit 49 at first converts the reproduced parameter into a linear prediction coefficient which may be called a $\alpha$ parameter. Thereafter, the autocorrelation unit 49 calculates autocorrelation of a weighted impulse response $h_w$ which is to be achieved by a LPC synthesizing filter (such as shown as synthesizing filter 17 in FIG. 1) having a weighted $\alpha$ parameter. When the weighted impulse response is represented by $h_w(n)$, n is variable within a range between 0 and $2L-2$.

The autocorrelation unit 49 calculates the autocorrelation $R_{hh}(r)$ which is given by:

$$R_{hh}(r) = \sum_{n=0}^{L-1} h_w(n)h_w(n+r), \tag{3}$$

where r is variable between 0 and $L-1$.

Moreover, the autocorrelation unit 49 normalizes the autocorrelation $R_{hh}(r)$ into normalized autocorrelation $\widetilde{R}_{hh}(r)$. The autocorrelation $R_{hh}(r)$ is symmetrical with respect to $r=0$ and has a maximum value at $r=0$. This means that $R_{hh}(r)$ is equal to $R_{hh}(-r)$. Accordingly, the normalized autocorrelation $\widetilde{R}_{hh}(r)$ can be obtained by dividing $R_{hh}(r)$ by $R_{rr}(o)$ and is produced as an autocorrelation signal representative of the normalized autocorrelation $\widetilde{R}_{hh}(r)$.

In the illustrated example, the inverse filter 46 of the cross-correlation unit 45 has a transfer function P(z) given by the use of a Z-transform by:

$$P(z) = 1 + \sum_{i=1}^{P} \alpha i\, z^{-i}. \tag{4}$$

From Equation (4), it is readily understood that the inverse filter 46 can be accomplished by a p-th order finite impulse response filter which has taps of $(p+1)$ and a plurality of delay elements between two adjacent taps. Such an inverse filter 46 can be accomplished in a usual manner and will not be described any further. The number p may be equal, for example, to ten or so. Thus, the inverse filter 46 has an inverse characteristic which is defined by the above-mentioned transfer function and which is variable at every frame in response to a parameter produced by the parameter analyzing unit 31. The parameter may be an $\alpha$ parmeter. In any event, the inverse characteristic of the inverse filter 46 is substantially inverse relative to the characteristic of the LPC synthesizing filter, namely, a vocal tract from which the input speech signal S(n) is produced.

Supplied with the input speech signal S(n), the inverse filter 46 equalizes the input speech signal S(n) in accordance with the inverse characteristic to produce an unequalized component which may be called a residue. The residue is substantially equivalent to the error signal e(n) illustrated in FIG. 1 and is therefore represented by e(n). The residue e(n) results from passage of the input speech signal S(n) through the inverse filter 46 and is represented by:

$$e(n)=S(n) * P(n). \tag{5}$$

On production of the residue e(n) in connection with the current frame, the delay elements of the inverse filter 46 are initially loaded with final values obtained with regard to a preceding frame.

Thus, the residue e(n) is delivered to the convolution filter 47 which is also supplied with the normalized autocorrelation $\widetilde{R}_{hh}(r)$.

Herein, it is pointed out that the cross-correlation $\widetilde{R}_{sh}(r)$ shown in FIG. 4 is rendered equal to convolution between the residue e(n) and the normalized autocorrelation $\widetilde{R}_{hh}(r)$ and is therefore given by:

$$\widetilde{R}_{sh}(r)=e(r) * \widetilde{R}_{hh}(r). \tag{6}$$

Inasmuch as the cross-correlation is calculated by the use of the normalized autocorrelation $\widetilde{R}_{hh}(r)$, the cross-correlation may be called a normalized cross-correlation and is represented by $\widetilde{R}_{sh}(r)$, as mentioned above.

In other words, it is understood that the normalized cross-correlation $\widetilde{R}_{sh}(r)$ is produced by the convolution filter 47, if the convolution filter 47 has a finite impulse response identical with the normalized autocorrelation $\widetilde{R}_{hh}(r)$, where r is variable within a range between L and $-L$, both inclusive.

Practically, such a convolution filter 47 can be accomplished by the use of a finite impulse response (FIR) filter which has $(2L+1)$ taps and a transfer function given by:

$$(1/P\gamma(z)) = 1/\left(1 + \sum_{i=1}^{P} \alpha i\, \gamma i\, z^{-i}\right)$$

where $\gamma$ takes a value between 0.8 and 0.9.

The convolution filter 47 produces an output signal given by:

$$
\begin{aligned}
e(r) * \widetilde{R}_{hh}(r) &= \sum_{m=0}^{N-1} e(m) \cdot \widetilde{R}_{hh}(r-m) \\
&= \sum_{m=0}^{N-1} e(m) \left( \sum_{n=0}^{N-1} h_w(n-m) \cdot h_w(n-r) \right) \\
&= \sum_{n=0}^{N-1} \left( \sum_{m=0}^{N-1} e(m) \cdot h_w(n-m) \right) \cdot h_w(n-r) \Big) \\
&= \sum_{n=0}^{N-1} (e(m) * h_w(n)) \cdot h_w(n-r) \\
&= \widetilde{R}_{sh}(r).
\end{aligned}
$$

Thus, it is practically possible to render the output signal of the convolution filter 47 equal to the normalized cross-correlation $\widetilde{R}_{sh}(r)$ between the perceptually weighted speech signal $S_w(n)$ and the impulse response of the synthesizing filter 34 (FIG. 2).

The normalized cross-correlation $\widetilde{R}sh(r)$ is sent as a cross-correlation signal to a pulse search circuit 39' together with the autocorrelation signal representative of the normalized autocorrelation $\widetilde{R}_{hh}(r)$.

Equation (2) is rewritten into:

$$
g_k = \max_{0 \leqq r_k \leqq N-1} \left| e(r_k) * R_{hh}(r_k) - \sum_{i=1}^{K-1} g_i R_{hh}(|r_k - r_i|) \right| \div |R_{hh}(0)|. \tag{7}
$$

Equation (7) can be normalized by $\widetilde{R}_{hh}(0)$ into:

$$
g_k = \max_{0 \leqq r_k \leqq N-1} \left| e(r_k) * \widetilde{R}_{hh}(r_k) - \sum_{i=1}^{K-1} g_i \widetilde{R}_{hh}(|r_k - r_i|) \right|. \tag{8}
$$

The pulse search circuit 39' successively searches for each of the excitation pulses in compliance with Equation (8). Therefore, the illustrated pulse search circuit 39' successively determines an amplitude and a location of each excitation pulse without carrying out division. The pulse search circuit 39' is therefore simple in structure in comparison with the pulse search circuit 39 illustrated in FIG. 2.

Figure 5:
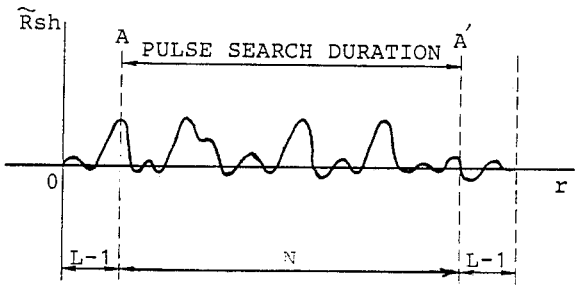
FIG. 5 shows a waveform for use in describing cross-correlation produced within the encoder illustrated in FIG. 4.

Referring to FIG. 5, the pulse search circuit 39' has a pulse search duration which is partitioned by a pair of lines A and A' and which is equal to a single one of the frames from arranging N samples. On the other hand, the normalized cross-correlation $\widetilde{R}_{sh}(r)$ appears for a time interval which is longer than the single frame by a duration of 2L samples. However, it is possible for the pulse search circuit 39' to calculate a quasi-optimum value from the normalized autocorrelation $\widetilde{R}_{hh}(r)$ and the normalized cross-correlation $\widetilde{R}_{sh}(r)$ even when the pulse search is carried out within a single frame of N samples. This is because the inverse filter 46 is of a non-recursive type and any peaks of the cross-correlation $\widetilde{R}_{sh}(r)$ scarcely appear at both ends of each pulse search duration. The numbers N and L may be, for example, 160 and 20, respectively.

The amplitude and the location of each excitation pulse is quantized by the output quantizer 40 into an encoded signal ES after a predetermined number of the excitation pulses is searched within each frame. The predetermined number may be equal to 31.

As mentioned above, the normalized autocorrelation $\widetilde{R}_{hh}(r)$ and the normalized cross-correlation $\widetilde{R}_{sh}(r)$ are calculated in the auto-correlation unit 49 and the cross-correlation unit 45. Therefore, it is possible to narrow dynamic ranges of the normalized autocorrelation $\widetilde{R}_{hh}(r)$ and the normalized cross-correlation $\widetilde{R}_{sh}(r)$ even when a fixed-point calculation is carried out. In addition, no compensation is necessary to remove interaction between two adjacent frames. Moreover, control of the pulse search becomes simple because the pulse search may be made only of about N samples. Inasmuch as no overlap takes place between two adjacent frames, it is possible to reduce a memory capacity of a memory included in the pulse search circuit 39'.

While this invention has thus far been described in conjunction with a preferred embodiment thereof, it will readily be possible for those skilled in the art to put this invention into practice in various other manners. For example, the inverse filter 46 may have a number of tapes which is not smaller than that of the convolution filter 47.

What is claimed is:

1. An encoder for use in encoding a speech signal, given through a vocal tract, into a plurality of excitation pulses, each pulse having an amplitude and a location determined by said speech signal, said encoder comprising:

parameter caculating means, responsive to said speech signal, for calculating a parameter specific to said speech signal and for producing a parameter signal representative of said parameter;

autocorrelation calculating means, responsive to said parameter signal, for calculating an autocorrelation related to said speech signal and for producing an autocorrelation signal representative of said autocorrelation;

cross-correlation calculating means, coupled to said autocorrelation calculating means and responsive to said speech signal, for calculating a cross-correlation related to said parameter and said speech signal and for producing a cross-correlation signal representative of said cross-correlation; and excitation pulse producing means, coupled to said autocorrelation calculating means and said cross-correlation calculating means, for producing said excitation pulses in response to said autocorrelation signal and said cross-correlation signal;

wherein said cross-correlation calculating means comprises:

an inverse filter responding to said speech signal and having an inverse filter characteristic relative to said vocal tract, said inverse filter producing a residual signal representative of a residue resulting from passage of said speech signal through said inverse filter;

filtering means, coupled to said inverse filter and said autocorrelation calculating means, for filtering said residual signal and for producing a filtered signal, said filtering means having an impulse response determined by said autocorrelation signal; and signal supplying means for supplying said filtered signal to said excitation pulse producing means as said cross-correlation signal.

2. An encoder as claimed in claim 1, wherein both said inverse filter and said filtering means are formed by a finite impulse response filter.

3. An encoder as claimed in claim 2, wherein said inverse filter is of a non-recursive type and wherein said filtering means is of a recursive type.

4. An encoder as claimed in claim 1, wherein said autocorrelation has a waveform which is substantially symmetrical with respect to a predertimed time instant and which has a maximum value at said predetermined time instant, and wherein said autocorrelation is normalized with reference to said maximum value into a normalized autocorrelation.

5. An encoder as claimed in claim 4, wherein said cross-correlation is normalized into a normalized cross-correlation with reference to said normalized autocorrelation.

6. An encoder as claimed in claim 4, wherein said excitation pulses are searched with reference to said normalized autocorrelation and said normalized cross-correlation.

* * * * *